US008967095B2

(12) United States Patent
Matsusaka et al.

(10) Patent No.: US 8,967,095 B2
(45) Date of Patent: Mar. 3, 2015

(54) ENGINE COOLING APPARATUS

(75) Inventors: Masanobu Matsusaka, Handa (JP); Tadayoshi Sato, Chita-gun (JP); Hirohisa Takano, Handa (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 0 days.

(21) Appl. No.: 13/883,144

(22) PCT Filed: Jan. 12, 2012

(86) PCT No.: PCT/JP2012/050475
§ 371 (c)(1),
(2), (4) Date: May 2, 2013

(87) PCT Pub. No.: WO2012/108224
PCT Pub. Date: Aug. 16, 2012

(65) Prior Publication Data

US 2013/0220243 A1 Aug. 29, 2013

(30) Foreign Application Priority Data

Feb. 10, 2011 (JP) ..... 2011-027570

(51) Int. Cl.
*F01P 1/06* (2006.01)
*F01P 7/14* (2006.01)
(Continued)

(52) U.S. Cl.
CPC . *F01P 7/14* (2013.01); *F01P 7/165* (2013.01); *F01P 2060/08* (2013.01); *F01P 5/12* (2013.01)
USPC ..... 123/41.85; 123/41.08; 123/41.01; 123/188.8; 123/41.05; 251/30.01; 165/244

(58) Field of Classification Search
USPC ..... 123/41.08, 41.85, 188.8, 41.05; 251/30.01, 30.03
See application file for complete search history.

(56) References Cited

U.S. PATENT DOCUMENTS 4,237,923 A 12/1980 Pressaco
4,399,775 A * 8/1983 Tanaka et al. ..... 123/41.08
(Continued)

FOREIGN PATENT DOCUMENTS

DE 196 35 044 A1 3/1997
DE 102 50 157 A1 5/2003
(Continued)

OTHER PUBLICATIONS

International Search Report issued Apr. 17, 2012 by the Japanese Patent Office in corresponding International Application No. PCT/JP2012/05075 and English language translation thereof (5 pgs).
(Continued)

*Primary Examiner* — Lindsay Low
*Assistant Examiner* — Syed O Hasan
(74) *Attorney, Agent, or Firm* — Buchanan Ingersoll & Rooney PC

(57) ABSTRACT

An engine cooling apparatus includes an engine for vehicle traveling, a pump driven by the engine, a heat exchanger, a circulation passage for circulating cooling liquid between the engine and the heat exchanger by driving the pump, a solenoid valve capable of opening/closing the circulation passage, and a controller for controlling operations of the engine. The solenoid valve includes a valve body movable between a position away from a valve seat and a position contacting the valve seat and held to contact the valve seat and a solenoid capable of maintaining contact between the valve body and the valve seat in response to supply of power thereto. When driving of the pump under a non-energized state of the solenoid, the valve body is movable to the position away from the valve seat by the cooling liquid fluid pressure.

7 Claims, 4 Drawing Sheets

(51) Int. Cl.

| | |
|---|---|
| ***F01P 9/00*** | (2006.01) |
| ***F01L 3/00*** | (2006.01) |
| ***F01P 7/02*** | (2006.01) |
| ***F16K 31/12*** | (2006.01) |
| ***F24F 11/04*** | (2006.01) |
| ***F01P 7/16*** | (2006.01) |
| *F01P 5/12* | (2006.01) |

(56) References Cited

U.S. PATENT DOCUMENTS

| | | | | |
|---|---|---|---|---|
| 4,782,862 | A * | 11/1988 | Nguyen | 137/630.14 |
| 5,596,878 | A * | 1/1997 | Hanson et al. | 62/160 |
| 5,598,718 | A * | 2/1997 | Freund et al. | 62/238.6 |
| 5,701,852 | A | 12/1997 | Suzuki et al. | |
| 6,749,173 | B2 * | 6/2004 | Heiling | 251/30.03 |
| 2006/0157002 | A1 * | 7/2006 | Pfeffinger et al. | 123/41.29 |
| 2006/0162677 | A1 * | 7/2006 | Piddock et al. | 123/41.1 |
| 2013/0020513 | A1 | 1/2013 | Matsusaka et al. | |
| 2013/0161547 | A1 | 6/2013 | Matsusaka et al. | |
| 2013/0240174 | A1 | 9/2013 | Matsusaka et al. | |

FOREIGN PATENT DOCUMENTS

| | | | |
|---|---|---|---|
| DE | 103 54 230 | A1 | 6/2005 |
| EP | 0 001 195 | A1 | 3/1979 |
| JP | 6-221461 | A | 8/1994 |
| JP | 6-323137 | A | 11/1994 |
| JP | 9-158724 | A | 6/1997 |
| JP | 10-103808 | A | 4/1998 |
| JP | 2000-303842 | A | 10/2000 |
| JP | 2001-12245 | A | 1/2001 |
| JP | 2006-37874 | A | 2/2006 |
| JP | 2006-138307 | A | 6/2006 |
| JP | 2006-524786 | A | 11/2006 |
| WO | 2004/097277 | A1 | 11/2004 |

OTHER PUBLICATIONS

European Search Report dated Mar. 25, 2014 for corresponding Application No. 12744737.3.

* cited by examiner

ENGINE COOLING APPARATUS

TECHNICAL FIELD

The present invention relates to an engine cooling apparatus including an engine for vehicle traveling, a pump driven by the engine, a heat exchanger, a circulation passage for circulating cooling liquid between the engine and the heat exchanger by driving of the pump, a solenoid valve capable of opening/closing the circulation passage, and a controller for controlling operations of the engine.

BACKGROUND ART

The above-described engine cooling apparatus is provided conventionally with a solenoid valve that can be switched to a valve closing state at the time of non-energization of the solenoid as the valve body is caused to contact the valve seat with the urging force of the urging member or can be switched to a valve opening state in response to energization of the solenoid as the valve body is moved against the urging force of the urging member (see PTL 1).

Accordingly, with the conventional engine cooling apparatus, for circulating cooling liquid between the engine and the heat exchanger, it is necessary to move the valve body against the urging force of the urging member with energization of the solenoid and also to maintain this energized state.

CITATION LIST

PTL 1: Japanese Unexamined Patent Application Publication No. 6-221461 (paragraphs [0012], [0013], FIG. 4).

SUMMARY OF INVENTION

Technical Problem

For this reason, the conventional engine cooling apparatus needs to be provided with a large solenoid valve having a large drive force capable of moving the valve body against the urging force of the urging member to a valve opening position in response to energization of the solenoid; hence, there is the possibility of enlargement of the apparatus.

Further, for circulation of cooling liquid, it is required to move the valve body against the urging force of the urging member to the valve opening position in response to energization of the solenoid and also to maintain this energized state. Hence, there is the possibility of increase of electric power consumption.

The present invention has been made in view of the above-described state of the art and its object is to provide an engine cooling apparatus that can be readily formed compact and that does not easily invite increase of power consumption.

Solution to Problem

According to a first characterizing feature of the present invention, an engine cooling apparatus comprises:

an engine for vehicle traveling;

a pump driven by the engine;

a heat exchanger;

a circulation passage for circulating cooling liquid between the engine and the heat exchanger by driving of the pump;

a solenoid valve capable of opening/closing the circulation passage; and a controller for controlling operations of the engine;

wherein the solenoid valve includes a valve body movable between a position away from a valve seat and a position contacting the valve seat and held to contact the valve seat and a solenoid capable of maintaining the contact between the valve body and the valve seat in response to supply of power thereto;

at the time of driving of the pump under a non-energized state of the solenoid, the valve body is movable to the position away from the valve seat by the fluid pressure of the cooling liquid; and the controller is configured to be controllable such that power supply to the solenoid is initiated before start-up of the engine.

With the engine cooling apparatus having the above-described inventive arrangement, the solenoid valve includes a valve body movable between a position away from a valve seat and a position contacting the valve seat and held to contact the valve seat and a solenoid capable of maintaining the contact between the valve body and the valve seat in response to supply of power thereto.

Therefore, the closed state can be positively maintained even by a small solenoid valve whose drive force is small and whose power consumption too is small. When the pump is driving with the solenoid being under non-energized state, the valve body is removed from the valve seat by the fluid pressure of the cooling liquid.

Further, when a vehicle that has been parked with stopping of its engine is now about to travel with restart of the engine or when a hybrid vehicle is switched from a motor-driven travel to an engine-driven travel or when at the time of e.g. restart of the engine after idling stop and it is desired to improve fuel consumption efficiency with warm-up of the engine since the temperature of cooling liquid has dropped, it is reliably possible to switch the solenoid valve to its closed state for stopping circulation of the cooling liquid.

However, with the solenoid valve configured as above, under non-energized state of the solenoid, if the engine is started to drive the pump, the valve body is removed from the valve seat by the fluid pressure of the cooling liquid. Therefore, switchover of the valve body from this state to the closed state requires a large drive force.

To cope with the above, according to the engine cooling apparatus having the above-described arrangement of the invention, the controller for controlling operations of the engine initiates power supply to the solenoid before start-up of the engine.

Namely, the valve body is caused to be adhered to the valve seat before the fluid pressure of the cooling liquid acts on the solenoid valve. So that, the closed state of the solenoid valve can be obtained in a reliable manner.

On the other hand, when it is desired to circulate the cooling liquid, the solenoid valve will be immediately switched over to its opened state by stopping the power supply to the solenoid.

As described above, with the inventive engine cooling apparatus capable of realizing the closed state of the valve body even in the absence of any circulation of cooling liquid, it is possible to employ a small solenoid valve whose drive force is small and whose power consumption too is small. As a result, compactization of the apparatus and reduction in electric power consumption are made possible.

Further, since a warm-up operation of the engine can be carried out speedily, improvement of fuel consumption efficiency is made possible.

According to a second characterizing feature of the present invention, the controller is configured to be controllable such that power supply to the solenoid is initiated upon detection of start-up of the engine.

With the above, the solenoid valve can be closed reliably prior to start-up of the engine. Further, since power supply to the solenoid is effected only when the engine is to be started actually, the period of energization of the solenoid can be shortened, such that further reduction in power consumption can be more readily possible.

According to a third characterizing feature of the present invention, the controller is configured to be controllable such that power supply to the solenoid is initiated upon stopping of the engine.

With the above-described arrangement, the power supply to the solenoid can be started to maintain the solenoid valve under the closed state before startup of engine is detected.

According to a fourth characterizing feature of the present invention, the controller determines whether to circulate the cooling liquid or not before start-up of the engine and the controller is configured such that the power supply to the solenoid is initiated if it has been determined that the cooling liquid is not to be circulated.

With the above-described arrangement, when the cooling liquid is to be circulated, the power supply to the solenoid is not initiated; whereas, the power supply to the solenoid is initiated when the cooling liquid is not to be circulated.

Therefore, when it is desired to circulate the cooling liquid, it is possible to eliminate such an unnecessary operation as starting the power supply to the solenoid first and then stopping this power supply. Consequently, there can be obtained an engine cooling apparatus having improved energy efficiency.

According to a fifth characterizing feature of the present invention, the heat exchanger comprises a heat exchanger for warming a vehicle cabin.

With the above-described arrangement, it is possible to maintain the solenoid valve under its closed state prior to engine startup, thereby to stop the circulation of the cooling liquid between the engine and the heat exchanger for warming of the vehicle cabin, so that the warm-up operation of the engine can be effected in an efficient manner.

DESCRIPTION OF EMBODIMENTS

Next, embodiments of the present invention will be described with reference to the accompanying drawings.

First Embodiment

Figure 1:
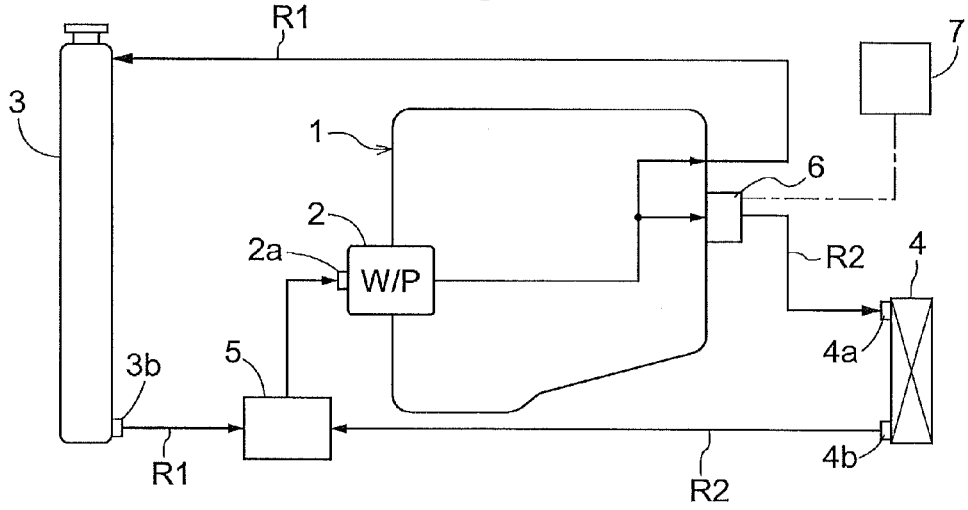
FIG. 1 is an explanatory view schematically showing an engine cooling apparatus.

FIG. 1 shows an engine cooling apparatus according to the present invention.

The engine cooling apparatus includes an internal combustion type engine 1 for vehicle travel, a water pump 2 driven by the engine 1, a radiator 3 as a heat exchanger for engine cooling, a heater core 4 as a heat exchanger for warming vehicle cabin, a first circulation passage R1 driven by the water pump 2 for circulating cooling liquid between the engine 1 and the radiator 3, a second circulation passage R2 driven by the water pump 2 for circulating cooling liquid between the engine 1 and the heater core 4, a thermostat valve 5 connected to the first circulation passage R1, a solenoid valve 6 capable of opening/closing the second circulation passage R2, and a controller 7 for controlling operations of the engine 1.

Therefore, the second circulation passage R2 for circulating cooling liquid between the engine 1 and the heater core 4 corresponds to what is referred to as "a circulation passage" in the context of the present invention.

The thermostat valve 5 is connected to a circulation passage portion in the first circulation passage R1 which portion extends between a cooling liquid outlet port 3*b* of the radiator 3 and a cooling liquid inlet port 2*a* of the water pump 2.

The solenoid valve 6 is connected to a circulation passage portion in the second circulation passage R2 which portion extends between a cooling liquid outlet port (not shown) for warming of the engine 1 and a cooling liquid inlet port 4*a* of the heater core 4.

The cooling liquid outlet port 4*b* of the heater core 4 is connected to the cooling liquid inlet port 2*a* of the water pump 2 via a passage (not shown) formed in the housing of the thermostat valve 5.

Incidentally, the water pump 2 is configured such that the drive of this pump is initiated in response to startup of the engine 1 and the drive is stopped in response to stop of the engine 1. Therefore, the water pump 2 is always driven during driving condition of the engine 1.

Figure 2:
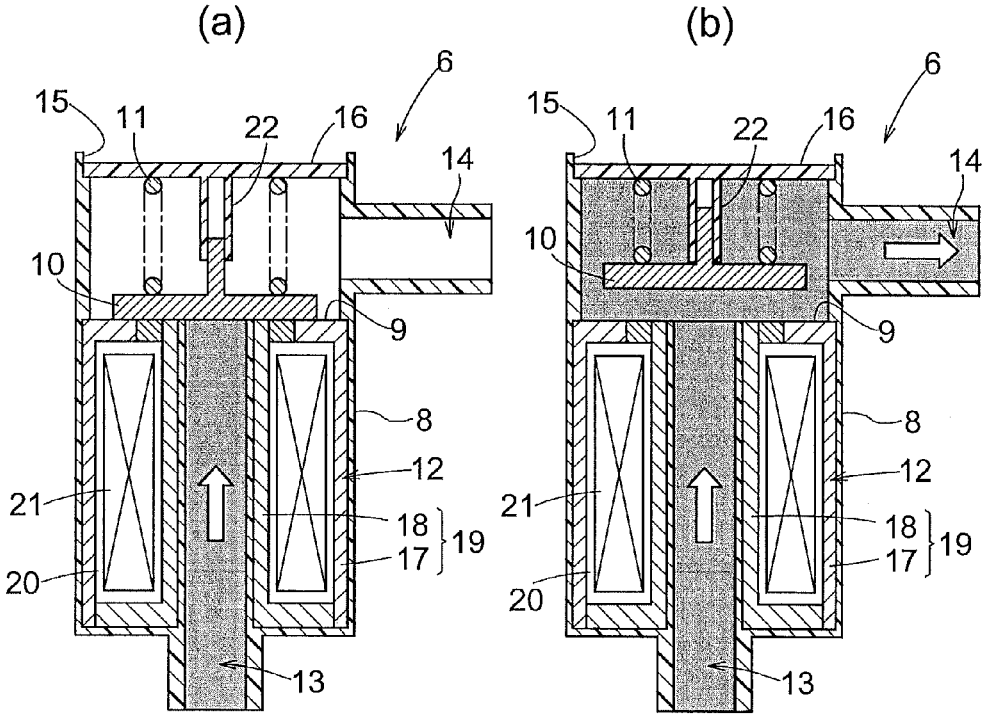
FIG. 2 shows a solenoid valve, (a) being a vertical section showing the valve under its closed state, (b) being a vertical section showing the valve under its opened state.

FIG. 2 (*a*) shows the solenoid valve 6 under its closed state. FIG. 2 (*b*) shows the solenoid valve 6 under its opened state.

The solenoid valve 6 includes housing 8, a valve body 10 mounted to be movable between a position away from a valve seat 9 and a position in contact with this valve seat 9, an urging member 11 for urging the valve body 10 so that this valve body 10 may contact the valve seat 9, and a solenoid 12 capable of maintaining the contact between the valve body 10 and the valve seat 9 with power supply thereto (energization).

The housing 8 includes a cooling liquid inlet passage 13, a cooling liquid outlet passage 14, an opening 15 formed to face the cooling liquid inlet passage 13 coaxially, and a cover 16 for closing the opening 15. The cooling liquid outlet passage 14 is formed in a direction perpendicular to the cooling liquid inlet passage 13.

The solenoid 12 includes a body 19 electrically connected to a drive circuit via an unillustrated connector and formed as a double-walled cylindrical body made of a magnetic material such as iron and having an outer diameter portion 17 and an inner diameter portion 18, a bobbin 20 mounted coaxially inside the body 19 and formed of an insulating material, and a length of an insulated copper wire 21 wound about the bobbin 20.

The body 19 is attached to the housing 8 in such a manner that the cooling liquid inlet passage 13 may coaxially extend into the inner diameter portion 18.

The valve seat 9 is formed of an end face of the body 19 which faces the side of the cover 16.

The valve body 10 is supported by a cylindrical bearing portion 22 formed in the cover 16 to be movable between the position away from the valve seat 19 and the position contacting this valve seat 9.

The urging member 11 for urging the valve body 10 into contact with the valve seat 9 is comprised of a compression coil spring mounted between the cover 16 and the valve body 10.

The valve body 10 is formed of a magnetic material such as iron. In operation, when the solenoid 12 is magnetized or energized in response to power supply thereto, the valve body 10 is attracted and adhered to the valve seat 9 formed in the body 19, and switched to the closed state with keeping the valve body 10 and the valve seat 9 in contact with each other.

When the solenoid 12 is not energized (no power supply thereto), the valve body 10 is placed in contact with the valve seat 9 with the urging force of the urging member 11.

Therefore, at the time of driving of the water pump 2 under the non-energized state of the solenoid 12, with the fluid pressure of the cooling liquid entering the cooling liquid inlet passage 13, the valve body 10 is moved to the position away from the valve seat 9 against the urging force of the urging member 11, and the cooling liquid flows out of the cooling liquid outlet passage 14 and enters the cooling liquid inlet port 4*a* of the heater core 4.

Figure 3:
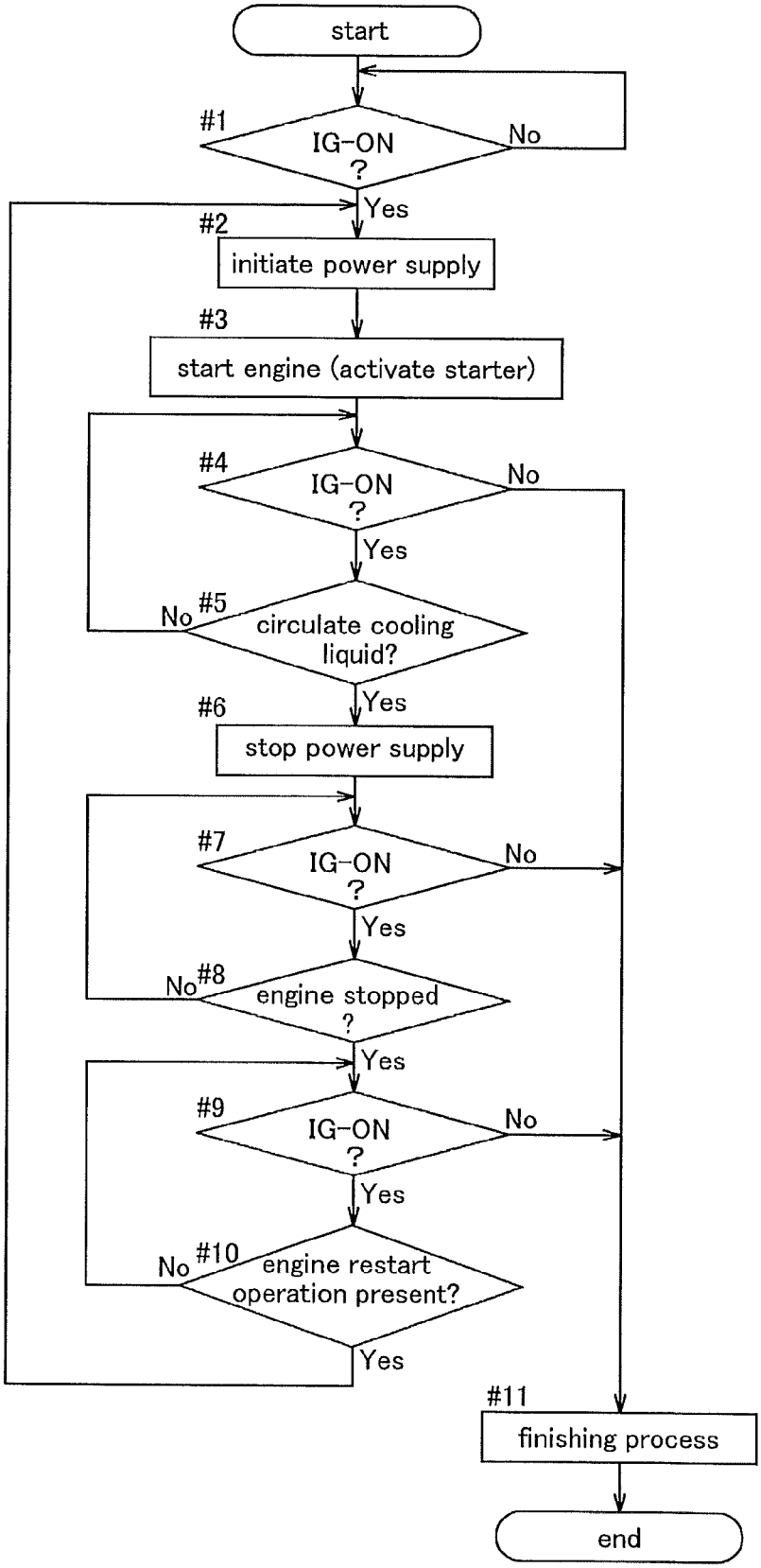
FIG. 3 is a control flowchart of a controller.

Next, the control operations by the controller 7 will be explained with reference to the flowchart shown in FIG. 3.

When an ignition key is inserted into the key cylinder and then the ignition is turned ON (show as "IG-ON" in the drawing), a startup operation of the engine 1 is detected and power supply to the solenoid 12 is initiated prior to the start-up of the engine 1 (steps #1, #2).

In response to the power supply to the solenoid 12, the valve body 10 is attracted and adhered to the valve seat 9, so that the solenoid valve 6 is switched over to the closed state with the valve body 10 and the valve seat 9 being maintained in contact with each other.

When the starter is activated by the ignition key and the engine 1 is started (step #3), driving of the water pump 2 is started.

Though not shown, an operation including both the ON operation of the ignition key and the activating operation of the starter may be detected as an engine startup operation.

In this case, regardless of an activating operation of the starter, after initiation of power supply to the solenoid 12, the engine 1 will be started and driving of the water pump 2 will be initiated.

Upon startup of the engine 1, it is determined whether to circulate the cooling liquid of the second circulation passage R2 or not under the ON-state of the ignition (steps #4, #5). If it is determined that the cooling liquid is not to be circulated, the power supply to the solenoid 12 is maintained. On the other hand, if it is determined that the cooling liquid is to be circulated, the power supply to the solenoid 12 is stopped (step #6).

Upon stop of the power supply to the solenoid 12, with the liquid pressure of the cooling liquid, the valve body 10 is moved to the position away from the valve seat 9 and the cooling liquid is caused to circulate in the second circulation passage R2.

The determination at step #5 of whether to circulate the cooling liquid of the second circulation passage R2 or not is effected, based on the temperature of the cooling liquid, presence/absence of vehicle cabin warming request, and the rotational speed of the engine 1.

More particularly, if the temperature of the cooling liquid is below a set temperature AND the vehicle cabin warming request is absent AND the rotational speed of the engine 1 is below a set rotational speed, it is determined that the cooling liquid is not to be circulated.

Therefore, if the temperature of the cooling liquid is over the set temperature OR the vehicle cabin warming request is present OR the rotational speed of the engine 1 is over the set rotational speed, it is determined that the cooling liquid is to be circulated.

Incidentally and alternatively, if the temperature of the cooling liquid is below a set temperature OR the vehicle cabin warming request is absent OR the rotational speed of the engine 1 is blow a set rotational speed, it may be determined that the cooling liquid is not to be circulated. And, if the temperature of the cooling liquid is over the set temperature AND the vehicle cabin warming request is present AND the rotational speed of the engine 1 is over the set rotational speed, it may be determined that the cooling liquid is to be circulated.

Under the ON condition of the ignition, if the engine 1 is stopped at the time of starting of a motor-driven travel of a hybrid vehicle or at the time of idling stop, the controller 7 determines presence/absence of a restart operation of the engine 1 (steps #7-#10).

Presence/absence of a restart operation of the engine 1 is determined based on an operational state of a brake pedal or an accelerator pedal.

More particularly, upon detection of a startup operation of the engine 1 involving release of a stepping-on of the brake pedal AND starting of a stepping-on of the accelerator pedal, the controller 7 determines this as the presence of a restart operation.

With the above determination of presence of a restart operation, the process returns to step #2, whereby power supply to the solenoid 12 is initiated prior to restart of the engine 1 and the control operations at steps #3 through #10 will be effected again.

If it is determined at steps #4, #7, #9 that an OFF operation of the ignition is present, a finishing process of e.g. stopping the power supply to the solenoid 12 is effected (step #11) and then the control process is terminated.

Incidentally, in case it is determined at step #5 that the cooling liquid is not to be circulated, it is determined whether the engine 1 has been stopped or not. Then, if it is determined that the engine 1 has been stopped, the power supply to the solenoid 12 may be stopped and then presence/absence of a restart operation of the engine 1 may be determined at step #10.

Second Embodiment

Figure 4:
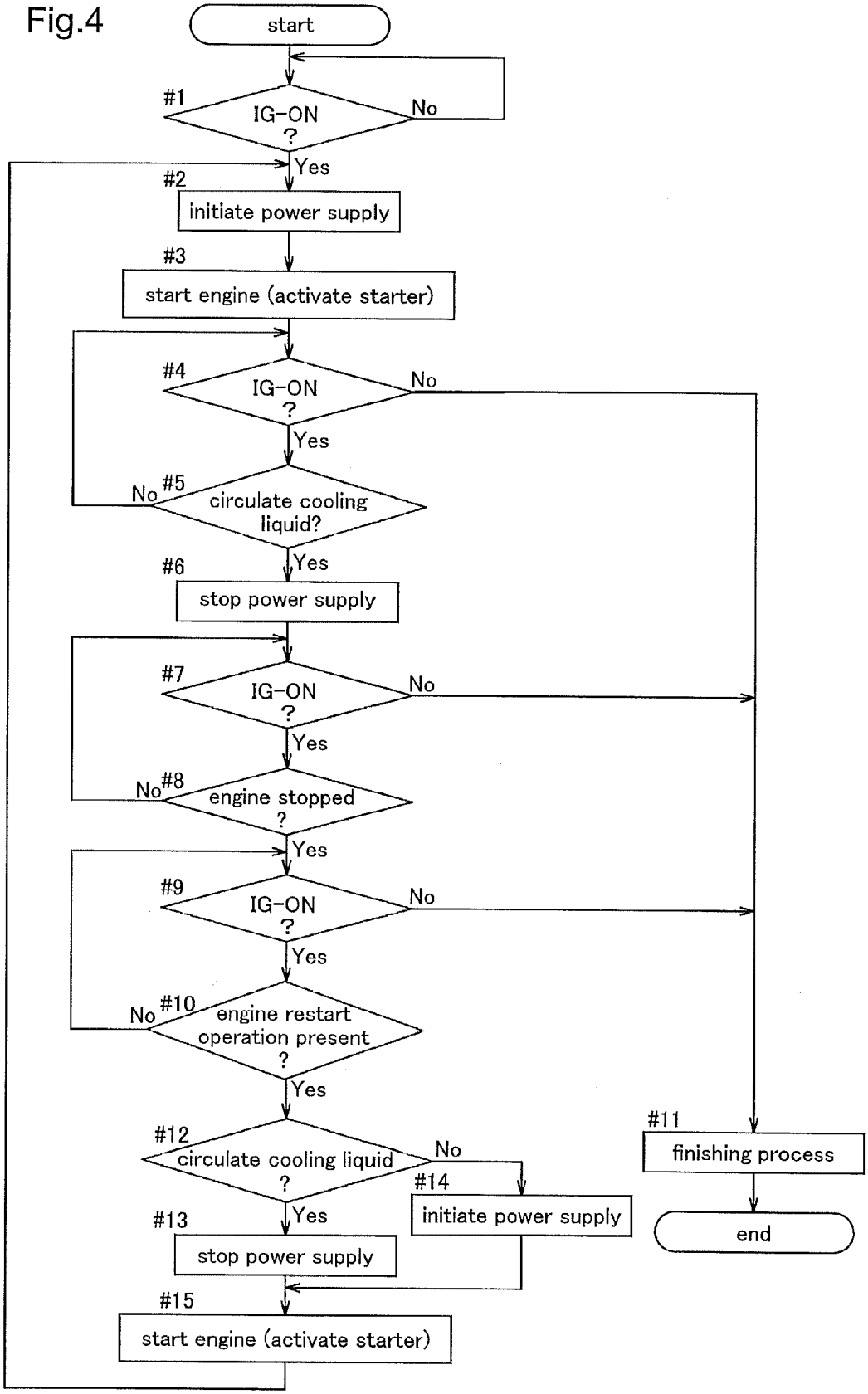
FIG. 4 is a control flowchart of a controller according to a second embodiment.

FIG. 4 shows a flowchart illustrating control operations according to a further embodiment of the present invention.

In this embodiment, after the controller 7 determines at step #10 that a restart operation of the engine 1 is present, the controller 7 determines whether to circulate the cooling liquid or not. And, if it is determined that the cooling liquid is not to be circulated, power supply to the solenoid 12 is initiated. In this respect, this further embodiment differs from the first embodiment.

Therefore, the control operations at steps #1 to #10 are same as those in the first embodiment, so that control operations at and after step #10 will be explained next.

If it is determined at step #10 that a restart operation of the engine 1 is present, it is then determined whether to circulate the cooling liquid or not (step #12). If it is determined that the cooling liquid is to be circulated, power supply, if any at present, to the solenoid 12 will be stopped and then the engine 1 will be started (steps #14, #15); then, the process returns to step #7.

If it is determined at step #12 that the cooling liquid is not to be circulated, power supply, if not any at present, to the solenoid 12 will be initiated and then the engine 1 will be started (steps #14, #15); then, the process will return to step #7.

The determination at step #12 of whether to circulate the cooling liquid or not is effected based on the temperature of the cooling liquid and presence/absence of vehicle cabin warming request.

Specifically, if the temperature of the cooling liquid is below the set temperature AND the vehicle cabin warming request is absent, it is determined that the cooling liquid is not to be circulated.

Therefore, it is determined that the cooling liquid is to be circulated if the temperature of the cooling liquid is over the set temperature OR a vehicle cabin warming request is present.

Alternatively, if the temperature of the cooling liquid is below the set temperature OR the vehicle cabin warming request is absent, it may be determined that the cooling liquid is not to be circulated. And, if the temperature of the cooling liquid is over the set temperature AND the vehicle cabin warming request is present, it may be determined that the cooling liquid is to be circulated.

The rest of the arrangement is identical to that of the first embodiment.

Third Embodiment

Figure 5:
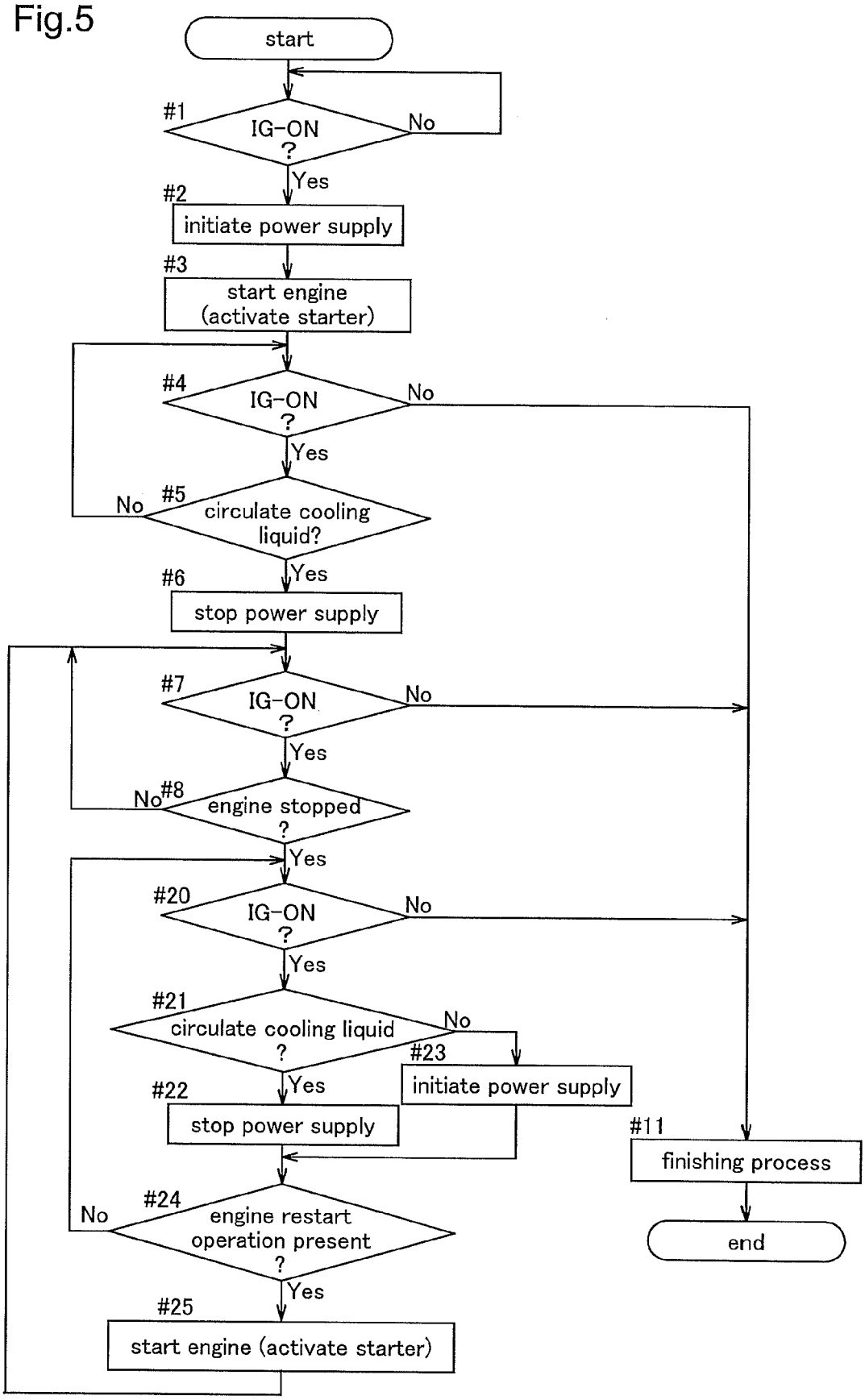
FIG. 5 is a control flowchart of a controller according to a third embodiment.

FIG. 5 shows a flowchart illustrating control operations according to a still further embodiment of the present invention.

In this embodiment, if it is detected at step #8 that the engine 1 has been stopped, the controller 7 determines whether to circulate the cooling liquid or not. Then, if it is determined that the cooling liquid is not to be circulated, the controller 7 initiates power supply to the solenoid 12. In this respect, this further embodiment differs from the first embodiment.

Therefore, the control operations at steps #1 to #8 are same as those in the first embodiment, so that control operations at and after step #8 will be explained next.

If it is detected at step #8 that the driving of the engine 1 has been stopped, it is then determined whether to circulate the cooling liquid or not under the ON state of the ignition (steps #20, #21). If it is determined that the cooling liquid is to be circulated, power supply, if any at present, to the solenoid 12 will be stopped and then it is determined whether a restart operation of the engine 1 is present or not (steps #22, #24).

Incidentally, the determination at step #21 of whether to circulate the cooling liquid or not is effected based on the temperature of the cooling liquid and presence/absence of vehicle cabin warming request, like the determination at step #12 in the second embodiment of whether to circulate the cooling liquid or not.

If it is determined at step #21 that the cooling liquid is not to be circulated, power supply, if not any at present, to the solenoid 12 will be initiated and then, it is determined whether a restart operation of the engine 1 is present or not (steps #23, #24).

If is determined at step #24 that a restart operation of the engine 1 is present, then, the engine 1 will be started (step #25) and then, the process returns to step #7.

If it is determined at step #20 that an OFF operation of the ignition is present, the controller 7 will effect a finishing process of e.g. stopping power supply to the solenoid 12 (step #11) and the control process will be terminated.

The rest of the arrangement is identical to that of the first embodiment.

Other Embodiments

1. The engine cooling apparatus according to the present invention may be applied to an engine cooling apparatus wherein a circulation passage for circulating cooling liquid between an engine and a radiator incorporates a solenoid valve, instead of a conventional thermostat valve capable of opening/closing this circulation passage.

2. The engine cooling apparatus according to the present invention may be configured such that the controller initiates power supply to the solenoid upon stop of the engine, without effecting the determination of whether to circulate the cooling liquid or not.

3. The engine cooling apparatus according to the present invention may be configured such that the solenoid valve includes a valve body movable between a position away from a valve seat and a position contacting the valve seat and held to contact the valve seat under the effect of gravity (self weight).

INDUSTRIAL APPLICABILITY

The engine cooling apparatus according to the present invention is applicable to a cooling apparatus for various kinds of internal combustion engines.

REFERENCE SIGNS LIST

1 engine
2 water pump
4 heater core (heat exchanger, heat exchanger for vehicle cabin heating)
6 solenoid valve
7 controller
9 valve seat
10 valve body
12 solenoid
R2 second circulation passage (circulation passage)

The invention claimed is:

1. An engine cooling apparatus comprising:
an engine for vehicle traveling;
a pump driven by the engine;
a heat exchanger;
a circulation passage for circulating cooling liquid between the engine and the heat exchanger by driving of the pump;
a solenoid valve capable of opening/closing the circulation passage; and
a controller for controlling operations of the engine;
wherein the solenoid valve includes a valve body movable between a position away from a valve seat and a position contacting the valve seat and held to contact the valve seat and a solenoid capable of maintaining the contact between the valve body and the valve seat in response to supply of power thereto, the solenoid including a cylindrical body defining an inner diameter and an outer diameter;
at the time of driving of the pump under a non-energized state of the solenoid, the valve body is movable to the position away from the valve seat by the fluid pressure of the cooling liquid;
the controller is configured to be controllable such that power supply to the solenoid is initiated before start-up of the engine; and a part of the circulation passage extends coaxially through the cylindrical body of the solenoid.

2. An engine cooling apparatus according to claim 1, wherein the controller is configured to be controllable such that power supply to the solenoid is initiated upon detection of start-up of the engine.

3. An engine cooling apparatus according to claim 1, wherein the controller is configured to be controllable such that power supply to the solenoid is initiated upon stopping of the engine.

4. An engine cooling apparatus according to claim 1, wherein the controller determines whether to circulate the cooling liquid or not before start-up of the engine and the controller is configured such that the power supply to the solenoid is initiated if it has been determined that the cooling liquid is not to be circulated.

5. An engine cooling apparatus according to claim 1, wherein the heat exchanger comprises a heat exchanger for warming a vehicle cabin.

6. An engine cooling apparatus according to claim 1, wherein the valve seat is formed in a body of the solenoid, and the valve body is formed of a magnetic material, and configured to be attracted and adhered to the valve seat in response to supply of power to the solenoid and switched to a closed state in which the contact between the valve body and the valve seat is maintained.

7. An engine cooling apparatus according to claim 1, further comprising an urging member for holding the valve body to contact the valve seat, wherein when the solenoid is in a non-energized state, the valve body is placed in contact with the valve seat with an urging force of the urging member.

* * * * *